US005918807A

United States Patent [19]

Doss

[11] Patent Number: 5,918,807

[45] Date of Patent: Jul. 6, 1999

[54] FIRE HOSE NOZZLE COVER APPARATUS

[76] Inventor: Jack Doss, 3215 Shelter Creek Ln., San Bruno, Calif. 94066

[21] Appl. No.: 08/931,582

[22] Filed: Sep. 16, 1997

[51] Int. Cl.[6] ..... B05D 15/00

[52] U.S. Cl. ..... 239/1; 239/288

[58] Field of Search ..... 239/440, 441, 239/288–288.5, 195–198, 1; 222/546, 562; 150/156, 154, 161

[56] References Cited

U.S. PATENT DOCUMENTS

| | | | |
|---|---|---|---|
| D. 332,292 | 1/1993 | Bloxsom . | |
| 2,678,847 | 5/1954 | Caird | 239/288.5 X |
| 4,344,573 | 8/1982 | De Felice | 239/320 |
| 4,733,799 | 3/1988 | Wiskur | 222/386 X |
| 5,042,105 | 8/1991 | Buck et al. . | |
| 5,178,923 | 1/1993 | Andrieu et al. . | |
| 5,193,602 | 3/1993 | Morales . | |
| 5,284,194 | 2/1994 | Gaffney . | |
| 5,378,522 | 1/1995 | Lagomarsino . | |
| 5,649,599 | 7/1997 | Catanese | 169/76 |

FOREIGN PATENT DOCUMENTS

| | | | |
|---|---|---|---|
| 1427729 | 10/1964 | France | 239/197 |

*Primary Examiner*—Kevin Weldon
*Attorney, Agent, or Firm*—Hovey, Williams, Timmons & Collins

[57] ABSTRACT

A fire hose nozzle cover apparatus (10) for a fire hose nozzle (12) includes cover structure (28) configured for covering at least a portion of a fire hose nozzle (12). The cover structure (28) broadly includes an end wall (30) and a tubular sidewall (32). The sidewall (32) has a first margin (34) coupled with and circumscribing the end wall (30) and has an opposed second margin (36). The end wall (30) and sidewall (32) cooperatively define a recess (38) for receiving and enclosing the nozzle (12) therein. Once the nozzle (12) is received in the recess (38), the second margin (36) of the sidewall (32) is then cinched about the rearward end (18) of the nozzle (12) to secure the nozzle (12) within the cover structure (28).

19 Claims, 2 Drawing Sheets

FIRE HOSE NOZZLE COVER APPARATUS

RELATED APPLICATIONS

Not applicable.

FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates to a fire hose nozzle cover apparatus. More particularly, the invention pertains to such an apparatus including an end wall and a tubular sidewall cooperatively defining a recess for receiving and enclosing at least a portion of the nozzle therein.

2. Description of the Prior Art

Fire hose nozzles are a key component in the arsenal of fire fighting equipment that are employed to extinguish a fire. Such nozzles can be sophisticated and expensive pieces of equipment with intricate components that must be fully operable at all times. Nozzles are manufactured in a multitude of sizes and often include interchangeable nozzle tips that provide variable spray patterns.

Fire hose nozzles are typically stowed in receptacles located on a fire truck, such as on the bumper of the truck. These receptacles are generally designed to retain the nozzles during non-use, but do not ordinarily safeguard the nozzle against the elements. Consequently, the nozzle is exposed to mud, snow, salt, insects and other undesirable items that tend to accumulate on the fire truck during travel to and from fires and other emergency sites.

Because a nozzle must be regularly cleaned and otherwise maintained in near perfect working order, the exposure of the nozzle to the elements during travel could ultimately result in increased maintenance costs and additional time and labor in respect of such maintenance. After excessive exposure, the nozzle may no longer be serviceable and complete replacement of the nozzle could be required. In a worst case scenario, the nozzle could malfunction at the scene of a fire as a result of such exposure.

SUMMARY OF THE INVENTION

The problems outlined above are in large measure solved by the fire hose nozzle cover apparatus in accordance with the present invention. That is to say, the apparatus hereof is specially designed to be easily and quickly placed over a fire hose nozzle and is a cost effective means for providing a protective cover for the nozzle. Once the nozzle or a portion thereof is secured within the cover apparatus, the nozzle and its intricate components will remain protected against the elements to thereby assure that the nozzle will be in a constant state of readiness for fire fighting.

The fire hose nozzle cover apparatus of the present invention broadly includes a cover structure adapted for covering a fire hose nozzle having an elongated body and a nozzle tip connected to the forward end of the body. The cover structure includes an end wall sized for completely covering the nozzle tip and a tubular sidewall having a first margin coupled with and circumscribing the end wall and an opposed second margin. The end wall and sidewall cooperatively define a recess for receiving and enclosing at least a portion of the nozzle.

In particularly preferred forms, the sidewall has a slit formed therein adjacent the second margin and extending at least a portion of the length of the sidewall. The slit facilitates the cinching of the second margin to secure the nozzle within the recess by overlapping opposed lapping portions of the sidewall bordering each side of the slit. Advantageously, the slit is of sufficient length for receiving a nozzle hand grip therethrough when the nozzle is secured within the recess.

Hook and loop closure members are preferably affixed to each respective lapping portion. When the closure members are placed in a mating relationship, the lapping portions are then releasably secured in a lapped configuration. Such lapped configuration results in the cinching of the second margin for thereby securing the nozzle within the cover structure.

The preferred embodiment also includes at least one pleat formed in the sidewall adjacent the second margin, and the recess is sufficiently sized for permitting the covering of a nozzle valve bale by the cover structure when the nozzle is secured within the cover structure. The cover structure is preferably composed of durable, water-resistant and flame-retardant material.

DETAILED DESCRIPTION OF THE PREFERRED EMBODIMENT

Figure 1:
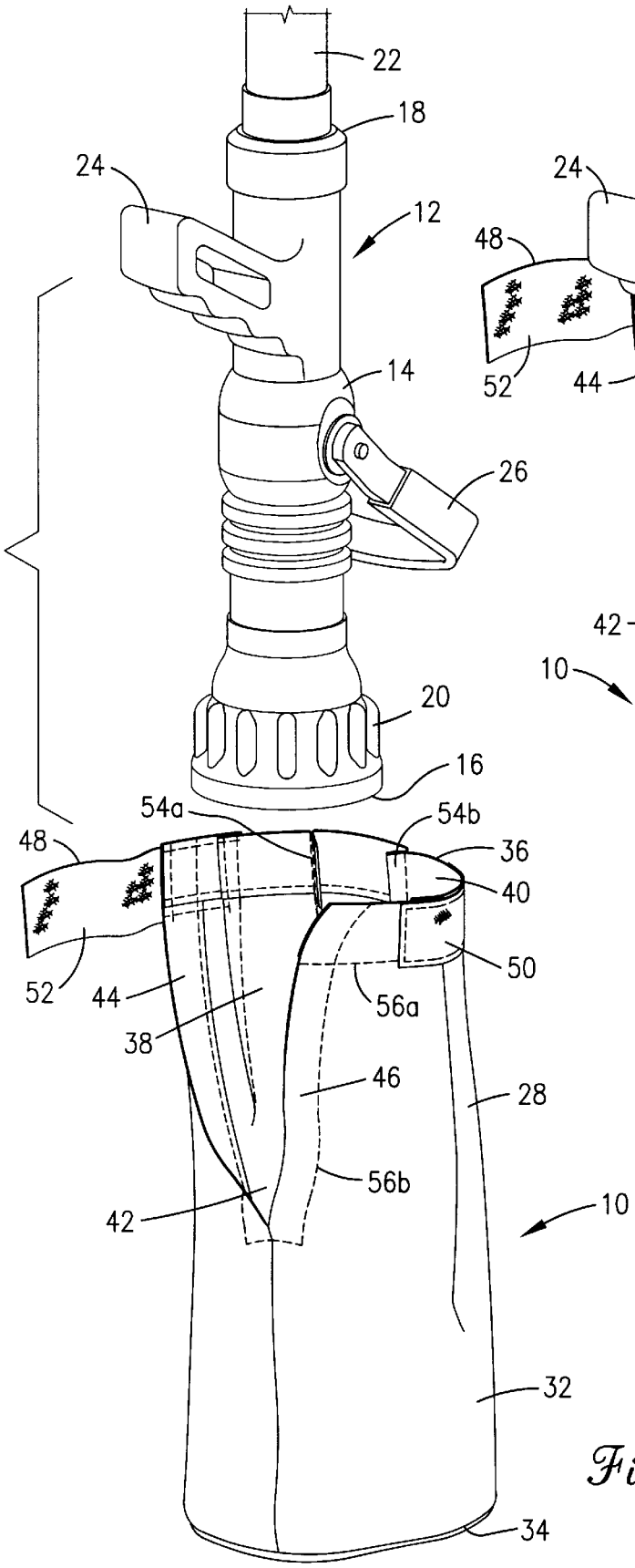
FIG. 1 is a pictorial view of the fire hose nozzle cover apparatus in accordance with the present invention shown in an opened condition with a fire hose nozzle.

Referring to the drawing figures, and in particular to FIG. 1, the cover apparatus 10 of the present invention is shown in an open condition along with a conventional fire hose nozzle 12. As illustrated, nozzle 12 includes an elongated body 14 having forward and rearward ends 16 and 18 and a nozzle tip 20 adjacent forward end 16. Rearward end 18 of nozzle 12 is provided with structure (not shown) for detachable coupling with a conventional fire hose 22. Nozzle 12 also includes a pistol-style hand grip 24 secured to and depending from the underside of body 14 proximal to the rearward end 18 and a valve bale 26 pivotally coupled to body 14 at an intermediate point between rearward and forward ends 16,18. It will be appreciated by those skilled in the art, however, that the teachings of the present invention may be applicable to other types and configurations of fire hose nozzles.

Apparatus 10 broadly includes cover structure 28 adapted for covering nozzle 12. Cover structure 28 includes a generally circular end wall 30 and a tubular sidewall 32. Structure 28 is preferably composed of durable, water-resistant and flame-retardant material, such as the material generally known in the industry as Pyrotone. Alternatively, cover structure 28 may be formed from other materials such as heavy canvas, woven nylon or plastic material.

In more detail, end wall 30 is sized for completely covering nozzle tip 20, it being appreciated that nozzle tips are often interchanged in order to provide the necessary spray pattern depending on the type of fire encountered. Sidewall 32 presents opposing first and second margins 34, 36, with first margin 34 being sewn to and thereby circumscribing end wall 30.

Figure 2:
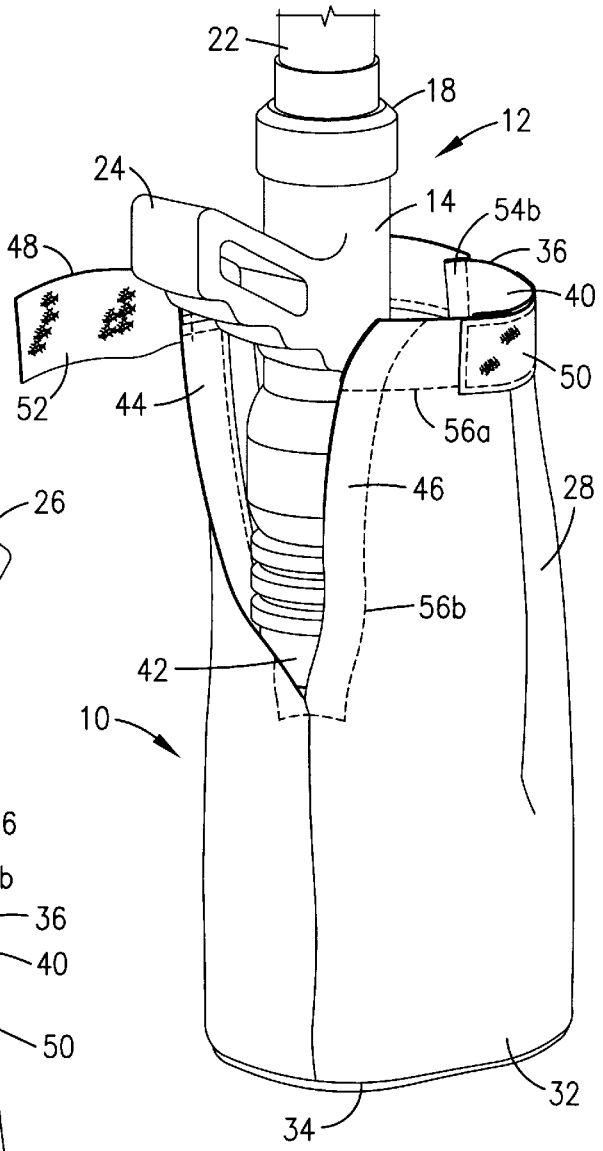
FIG. 2 is a pictorial view similar to that of FIG. 1, but showing the fire hose nozzle being received within the cover apparatus.
Figure 3:
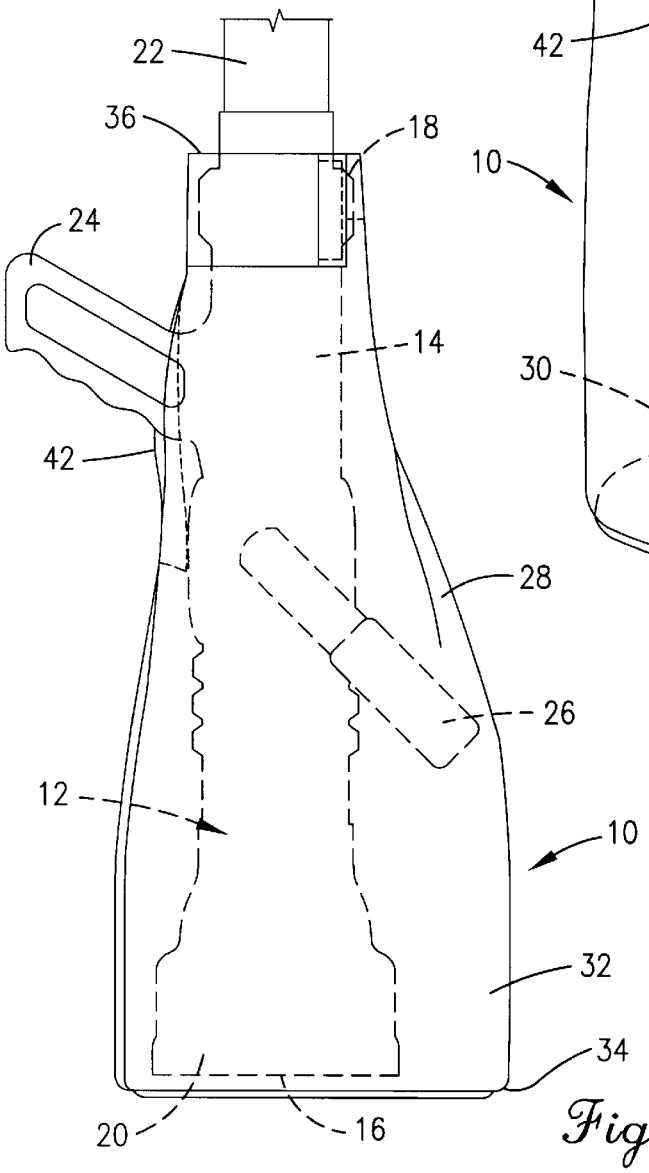
FIG. 3 is a side elevational view of the cover apparatus of FIG. 1, showing the nozzle secured within the cover apparatus, and illustrating the secured nozzle in phantom.

End wall 30 and sidewall 32 cooperatively define a recess 38 for receiving and enclosing nozzle 12 therein (see FIGS. 2 and 3). Recess 38 is preferably of sufficient size so that valve bale 26 will be covered by cover structure 28 when nozzle 12 is secured within cover structure 28. Second margin 36 defines a nozzle-receiving opening 40 adjacent recess 38.

In preferred forms, sidewall 32 has a length not less than the length of nozzle 12 and includes a slit 42 formed adjacent second margin 36 and extending along at least a portion of the length of said sidewall 32. The length of slit 42 is sufficient for receiving hand grip 24 therethrough when nozzle 12 is secured within cover structure 28, as illustrated in FIG. 3. The slit length also affects the cinching of the second margin 36 when nozzle 12 is received and enclosed within the recess 38, as described in further detail below.

Sidewall 32 further includes opposing first and second lapping portions 44 and 46 adjacent and bordering on each side of slit 42. First and second hook and loop closure members (e.g., Velcro strips) 48 and 50 are affixed to respective first and second lapping portions 44, 46 adjacent second margin 36. Segment 52 of first closure member 48 extends outwardly from sidewall 32 in a direction generally transverse to the longitudinal axis of sidewall 32.

Cover structure 28 advantageously includes pleats 54*a* and 54*b* sewn into sidewall 32 adjacent second margin 36 and extending into recess 38. Pleats 54*a,b* provide a tapered appearance to sidewall 32 such that opening 40 is smaller in diameter than end wall 30 when nozzle 12 is secured within cover structure 28 (see FIG. 3). In addition, inclusion of pleats 54*a,b* facilitates cinching of second margin 36.

Figure 4:
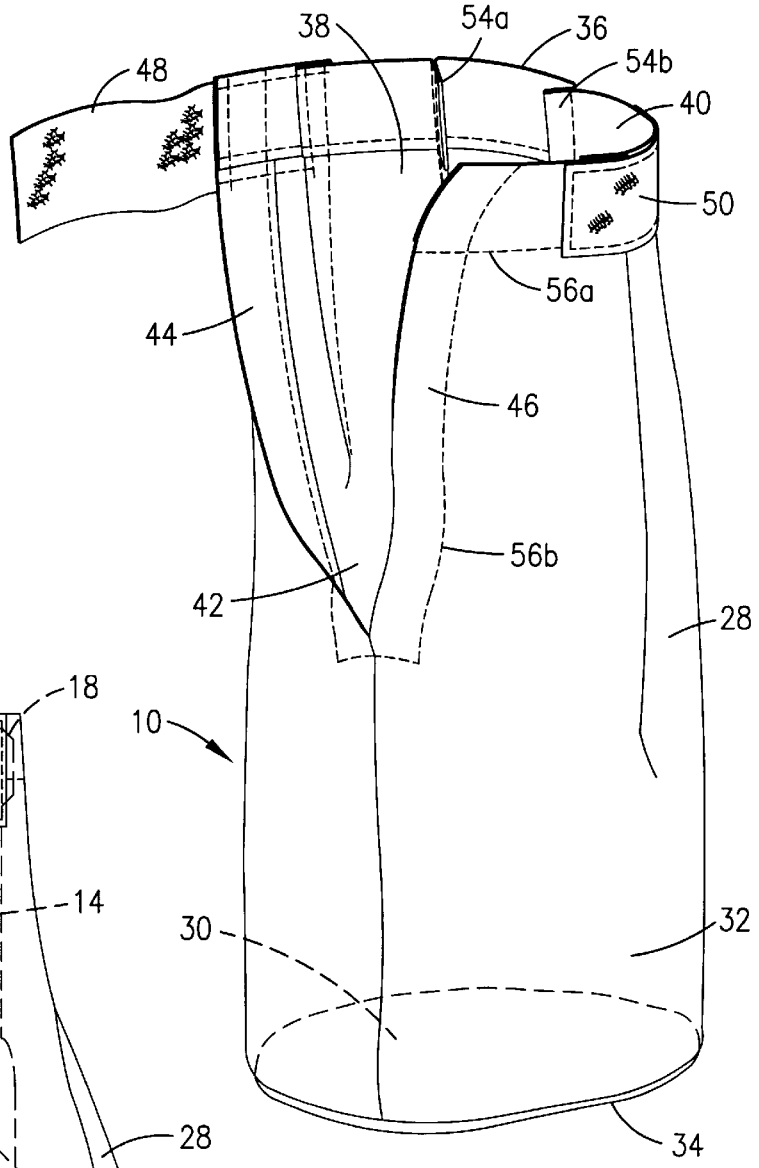
FIG. 4 is another pictorial view of the cover apparatus of FIG. 1 showing a portion of the end wall in phantom.

The various components of cover structure 28 are sewn together using heavy thread (not shown). To provide additional strength and durability, reinforced stitching 56*a,b* is provided adjacent second margin 36 and slit 42, as shown in FIG. 4. However, those skilled in the art will appreciate that cover structure 28 may be of integral construction.

In use, FIG. 1 illustrates the cover apparatus 10 in an open condition for receiving nozzle 12 within cover structure 28, with closure members 48, 50 detached from each other and second margin 36 in a non-cinched state. To cover nozzle 12, the user places nozzle 12 through opening 40 and into recess 38. To accommodate valve bale 26 and other components included with nozzle 12, opening 40 is spread by extending lapping portions 44, 46 outwardly to increase the width of slit 42 as needed. If nozzle 12 includes hand grip 24, nozzle 12 is oriented during placement so that hand grip 24 is aligned with slit 42 as depicted in FIG. 2.

Once nozzle tip 20 engages end wall 30, the user cinches second margin 36 to secure nozzle 12 within cover structure 28. As viewed in FIG. 3, the user positions lapping portions 44, 46 in a lapped or superposed configuration until margin 36 snugly engages nozzle 12. Segment 52 of first closure member 48 is then interconnected with second closure member 50 in a mating relationship to maintain the lapped configuration of lapping portions 44, 46 and thus tightly cinch second margin 36 about rearward end 18 of nozzle body 14. In such condition, hand grip 24 extends outwardly through slit 42, and cover structure 28 encloses the remainder of nozzle 12. Once secured within cover apparatus 10, nozzle 12 and its intricate components will remain protected against the elements to thereby assure that nozzle 12 will be in a constant state of readiness for fire fighting.

It will be appreciated that partial coverage of nozzle 12 will result if the length of sidewall 32 is less than the length of the nozzle 12. Such partial coverage may also result if recess 38 is not sufficiently sized to accommodate valve bale 26 or other components included with nozzle 12. In either such case, cinching of second margin 36 about nozzle body 14 will occur at a position between rearward and forward ends 16, 18, and nozzle 12 will then be partially covered by cover apparatus 10. On the other hand, if the sidewall length is greater than the nozzle length and recess 38 is sufficiently sized, second margin 36 will be cinched about fire hose 22, and nozzle 12 will be completely covered by cover structure 28.

It will be further appreciated that the cover apparatus 10 of the present invention may be constructed without slit 42 formed in sidewall 32. In this event, cinching of second margin 36 may be accomplished by folding over portions of sidewall 32 adjacent second margin 36 in a lapped configuration. Additional pleats could be included to facilitate such cinching.

Those skilled in the art will appreciate that the teachings of the cover apparatus hereof may include a variety of embodiments in addition to the preferred embodiment hereinabove described. For example, depending on the type and configuration of nozzle and nozzle tip involved, and whether the nozzle includes a hand grip, valve bale or other attached components, the size, shape and arrangement of components to the cover apparatus may require appropriate modification.

What is claimed is:

1. A combination comprising:

a fire hose nozzle including an elongated body having forward and rearward ends and a nozzle tip connected to the forward end, the rearward end being adapted for detachable coupling with a fire hose; and a fire hose nozzle cover apparatus for covering the fire hose nozzle, the cover apparatus including cover structure configured for selective placement in covering relationship with the nozzle, said cover structure including an end wall sized for completely covering the nozzle tip, a tubular sidewall having a first margin coupled with and circumscribing said end wall and having an opposed second margin, said end wall and said sidewall cooperatively defining a recess for receiving and enclosing at least a portion of the nozzle therein, and means for releasably cinching said second margin for securing at least a portion of the nozzle within said recess.

2. The combination of claim 1, said sidewall presenting a slit formed adjacent said second margin and extending along at least a portion of the length of said sidewall, said sidewall having a first lapping portion and an opposed second lapping portion with said slit therebetween and each lapping portion being proximal to said second margin, said cinching means including a pair of hook and loop closure members each respectively affixed to said lapping portions such that said closure members are placed in a mating relationship with each other for releasably securing said lapping portions in a lapped configuration, the nozzle including a valve bale pivotally connected to the nozzle body, said recess being sufficiently sized such that the bale is covered by said cover structure when at least a portion of the nozzle is secured within said cover structure.

3. The combination of claim 1, said sidewall presenting a slit formed adjacent said second margin and extending along at least a portion of the length of said sidewall.

4. The combination of claim 3, said sidewall having a first lapping portion and an opposed second lapping portion with said slit therebetween and each lapping portion being proximal to said second margin, said cinching means including a pair of hook and loop closure members each respectively affixed to said lapping portions such that said closure members are placed in a mating relationship with each other for releasably securing said lapping portions in a lapped configuration.

5. The combination of claim 3, the nozzle including a hand grip attached to the nozzle body, said slit being of sufficient length for receiving the hand grip therethrough when at least a portion of the nozzle is secured within said cover structure.

6. The combination of claim 1, said sidewall having a length not less than the length of the nozzle.

7. The combination of claim 1, said sidewall having a pleat formed therein adjacent said second margin and extending along at least a portion of the length of said sidewall.

8. The combination of claim 1, said cover structure being composed of durable, water-resistant and flame-retardant material.

9. The combination of claim 1, the nozzle including a valve bale pivotally connected to the nozzle body, said recess being sufficiently sized such that the bale is covered by said cover structure when at least a portion of the nozzle is secured within said cover structure.

10. A fire hose nozzle cover apparatus for covering a fire hose nozzle, the nozzle including an elongated body having forward and rearward ends and a nozzle tip connected to the forward end, the rearward end being adapted for detachable coupling with a fire hose, said cover apparatus comprising:

cover structure configured for selective placement in covering relationship with the nozzle, said cover structure including an end wall sized for completely covering the nozzle tip, a tubular sidewall having a first margin coupled with and circumscribing said end wall and having an opposed second margin, said end wall and and said sidewall cooperatively defining a recess for receiving and enclosing at least a portion of the nozzle therein, said sidewall presenting a slit formed adjacent said second margin and extending along at least a portion of the length of said sidewall; and means for releasably cinching said second margin for securing at least a portion of the nozzle within said recess.

11. The cover apparatus of claim 10, said sidewall having a first lapping portion and an opposed second lapping portion with said slit therebetween and each lapping portion being proximal to said second margin, said cinching means including a pair of hook and loop closure members each respectively affixed to said lapping portions such that closure members are placed in a mating relationship with each other for releasably securing said lapping portions in a lapped configuration, the nozzle including a valve bale pivotally connected to the nozzle body, said recess being sufficiently sized such that the bale is covered by said cover structure when at least a portion of the nozzle is within said cover structure.

12. The cover apparatus of claim 10, said sidewall having a first lapping portion and an opposed second lapping portion with said slit therebetween and each lapping portion being proximal to said second margin, said cinching means including a pair of hook and loop closure members each respectively affixed to said lapping portions such that said closure members are placed in a mating relationship with each other for releasably securing said lapping portions in a lapped configuration.

13. The cover apparatus of claim 10, the nozzle including a hand grip attached to the nozzle body, said slit being of sufficient length for receiving the hand grip therethrough when at least a portion of the nozzle is secured within said cover structure.

14. The cover apparatus of claim 10, said sidewall having a pleat formed therein adjacent said second margin and extending along at least a portion of the length of said sidewall.

15. The cover apparatus of claim 10, the nozzle including a valve bale pivotally connected to the nozzle body, said recess being sufficiently sized such that the bale is covered by said cover structure when the nozzle is secured within said cover structure.

16. A method of covering a fire hose nozzle, the nozzle including an elongated body having forward and rearward ends and a nozzle tip connected to the forward end, the rearward end being adapted for detachable coupling with a fire hose, said method comprising the steps of:

(a) placing a cover structure in covering relationship with at least a portion of the nozzle, said cover structure including an end wall sized for completely covering the nozzle tip, a tubular sidewall having a first margin coupled with and circumscribing said end wall and having an opposed second margin, said end wall and said sidewall cooperatively defining a recess for receiving and enclosing at least a portion of the nozzle therein; and (b) releasably cinching said second margin and thereby securing at least a portion of the nozzle within said recess.

17. The method of claim 16, said sidewall presenting a slit formed adjacent said second margin and extending along at least a portion of the length of said sidewall, said sidewall having a first lapping portion and an opposed second lapping portion with said slit therebetween and each lapping portion being proximal to said second margin, said lapping portions having a pair of hook and loop closure members each respectively affixed to said lapping portions, step (b) including the step of placing the closure members in a mating relationship with each other and thereby releasably securing said lapping portions in a lapped configuration.

18. The method of claim 16, the nozzle including a hand grip attached to the nozzle body, said sidewall presenting a slit formed adjacent said second margin and extending along at least a portion of the length of said sidewall, said method including the step of placing the hand grip through said slit when securing at least a portion of the nozzle within said cover structure.

19. The method of claim 16, the nozzle including a valve bale pivotally connected to the nozzle body, said method including the step of covering said bale with said cover structure when securing at least a portion of the nozzle within said cover structure.

* * * * *